US008256099B2

(12) United States Patent
Shoji et al.

(10) Patent No.: US 8,256,099 B2
(45) Date of Patent: Sep. 4, 2012

(54) MANUFACTURING METHOD FOR A THERMAL HEAD

(75) Inventors: Noriyoshi Shoji, Chiba (JP); Norimitsu Sanbongi, Chiba (JP); Yoshinori Sato, Chiba (JP); Toshimitsu Morooka, Chiba (JP); Keitaro Koroishi, Chiba (JP)

(73) Assignee: Seiko Instruments Inc. (JP)

( * ) Notice: Subject to any disclaimer, the term of this patent is extended or adjusted under 35 U.S.C. 154(b) by 492 days.

(21) Appl. No.: 12/589,139

(22) Filed: Oct. 19, 2009

(65) Prior Publication Data

US 2010/0115760 A1 May 13, 2010

(30) Foreign Application Priority Data

Oct. 20, 2008 (JP) ..... 2008-269765

(51) Int. Cl.
*H05B 3/00* (2006.01)

(52) U.S. Cl. ..... 29/611; 29/613; 29/620; 29/841; 29/874

(58) Field of Classification Search ..... 29/611, 29/613, 620, 841, 846, 874, 877; 347/197, 347/202, 205, 207, 208
See application file for complete search history.

(56) References Cited

U.S. PATENT DOCUMENTS 5,940,109 A * 8/1999 Taniguchi et al. ..... 347/205
7,522,178 B2 * 4/2009 Shoji et al. ..... 347/205

FOREIGN PATENT DOCUMENTS

JP 2007-83532 * 4/2007

* cited by examiner

*Primary Examiner* — Thiem Phan
(74) *Attorney, Agent, or Firm* — Adams & Wilks

(57) ABSTRACT

The manufacturing method for a thermal head includes: forming a hollow concave portion and a marking concave portion having a depth larger than a depth of the hollow concave portion on one surface of a thin plate glass; a bonding step of bonding a supporting plate onto the one surface of the thin plate glass, in which the hollow concave portion and the marking concave portion are formed in the concave portion forming step; a thinning step of thinning the thin plate glass onto which the supporting plate is bonded in the bonding step until the marking concave portion extends through the substrate from a side of a back surface opposite to the one surface; and a heating resistor forming step of forming a heating resistor on the back surface of the thin plate glass thinned in the thinning step so as to be opposed to the hollow concave portion.

6 Claims, 9 Drawing Sheets

MANUFACTURING METHOD FOR A THERMAL HEAD

BACKGROUND OF THE INVENTION

1. Field of the Invention

The present invention relates to a manufacturing method for a thermal head.

2. Description of the Related Art

There have been conventionally known a thermal head which is used in a thermal printer often mounted to a portable information equipment terminal typified by a compact hand-held terminal, and which is used to perform printing on a thermal recording medium based on printing data with the aid of selective driving of a plurality of heating elements (for example, see JP 2007-320197 A).

In terms of an increase in efficiency of the thermal head, there is a method of forming a heat insulating layer below a heating portion of a heating resistor. By formation of the heat insulating layer below the heating portion, of an amount of heat generated on the heating resistor, an amount of upper-transferred heat which is transferred to an abrasion resistance layer formed above the heating portion becomes larger than an amount of lower-transferred heat which is transferred to a heat storage layer formed below the heating portion, and hence energy efficiency required during printing can be sufficiently obtained. In the thermal head described in JP 2007-320197 A, a hollow portion is provided between a substrate and a supporting plate which are integrated with each other, and this hollow portion functions as a hollow heat insulating layer. Thus, the amount of upper-transferred heat becomes larger than the amount of lower-transferred heat, and the energy efficiency is increased.

In the manufacturing method for the thermal head described in JP 2007-320197 A, a gap portion is formed inside a protrusion which is formed on one surface of the substrate, and the flat supporting plate is fused and bonded onto the other surface thereof to enclose the gap portion, whereby the hollow portion is formed. In this manufacturing method, there is a risk that the substrate breaks because the hollow portion is formed before the substrate is reinforced by the supporting plate, and there is a problem that it is difficult to handle the substrate during a manufacturing process. Further, an original thickness of each of the substrates varies, and hence there is a problem that it is difficult to control the thickness of the substrate serving as the heat storage layer above the hollow portion.

SUMMARY OF THE INVENTION

The present invention has been made in view of the above-mentioned circumstances, and an object of the present invention is therefore to provide a manufacturing method for a thermal head, which enables to manufacture a thermal head having high heating efficiency and stable quality.

In order to achieve the above-mentioned object, the present invention provides the following means.

The present invention provides a manufacturing method for a thermal head, comprising:

a concave portion forming step of forming a hollow concave portion and a marking concave portion having a depth larger than a depth of the hollow concave portion on one surface of a substrate;

a bonding step of bonding a supporting plate onto the one surface of the substrate, in which the hollow concave portion and the marking concave portion are formed in the concave portion forming step;

a thinning step of thinning the substrate onto which the supporting plate is bonded in the bonding step until the marking concave portion extends through the substrate from a side of a back surface opposite to the one surface; and a heating resistor forming step of forming a heating resistor on the back surface of the substrate thinned in the thinning step so as to be opposed to the hollow concave portion.

According to the present invention, in the bonding step, the hollow concave portion of the substrate, which is formed in the concave portion forming step, is covered with the supporting plate, whereby a hollow portion is formed between the substrate and the supporting plate. The hollow portion functions as a hollow heat insulating layer, and suppresses the transfer of heat generated in a heating portion of the heating resistor to the supporting plate through an intermediation of the substrate serving as a heat storage layer. (Hereinafter, the substrate incorporated in the thermal head is referred to as "heat storage layer.") Therefore, it is possible to manufacture the thermal head having high energy efficiency. Further, a thickness of the hollow portion is determined based on a depth of the hollow concave portion, and hence it is possible to easily control a thickness of the hollow heat insulating layer.

In this case, a thickness of a thin plate portion situated above the hollow portion of the heat storage layer which supports the heating resistor is determined by a difference between the depth of the hollow concave portion and a depth of the marking concave portion. Therefore, in the concave portion forming step, even though each of the hollow concave portion and the marking concave portion is solely formed so as to have a desired depth, it is possible to control a thickness of the thin plate portion precisely. Further, each of the concave portions is formed in the substrate which has not been thinned yet, and the substrate is thinned while being reinforced by the supporting plate, whereby it is possible to prevent the hollow portion from breaking during the manufacturing process. Thus, it is possible to manufacture the thermal head having high heating efficiency and stable quality.

In the above-mentioned aspect of the present invention, in the concave portion forming step, the hollow concave portion and the marking concave portion may be formed such that a difference between the depth of the hollow concave portion and the depth of the marking concave portion is set to be equal to a thickness of the substrate on which the heating resistor is supported.

With the structure as described above, in the thinning step, only by thinning the substrate until the marking concave portion extends through the substrate, it is possible to control the substrate which supports the heating resistor, that is, the thin plate portion of the heat storage layer to have a desired thickness.

Further, in the above-mentioned aspect of the present invention, it is possible to provide a barrier film forming step of forming a barrier film for reducing an etching rate in a region of the one surface of the substrate, in which the hollow concave portion is formed, and, in the concave portion forming step, etching may be performed in the region of the one surface of the substrate, in which the hollow concave portion is formed and in a region of the one surface of the substrate, in which the marking concave portion is formed.

A difference between an etching rate of the hollow concave portion and an etching rate of the marking concave portion is provided by the barrier film. As a result, in the concave portion forming step, it is possible to form the hollow concave portion and the marking concave portion having depths different from each other in one etching process.

Further, in the above-mentioned aspect of the present invention, in the concave portion forming step, hot pressing may be performed in a region of the one surface of the substrate, in which the hollow concave portion is formed and in a region of the one surface of the substrate, in which the marking concave portion is formed.

By the hot pressing, it is possible to easily form the hollow concave portion and the marking concave portion each having a desired depth.

According to the present invention, there can be achieved the effect of enabling manufacture of the thermal head having high heating efficiency and stable quality.

DETAILED DESCRIPTION OF THE PREFERRED EMBODIMENT

First Embodiment

Hereinafter, with reference to the drawings, a manufacturing method A for a thermal head according to a first embodiment of the present invention is described.

Figure 1:
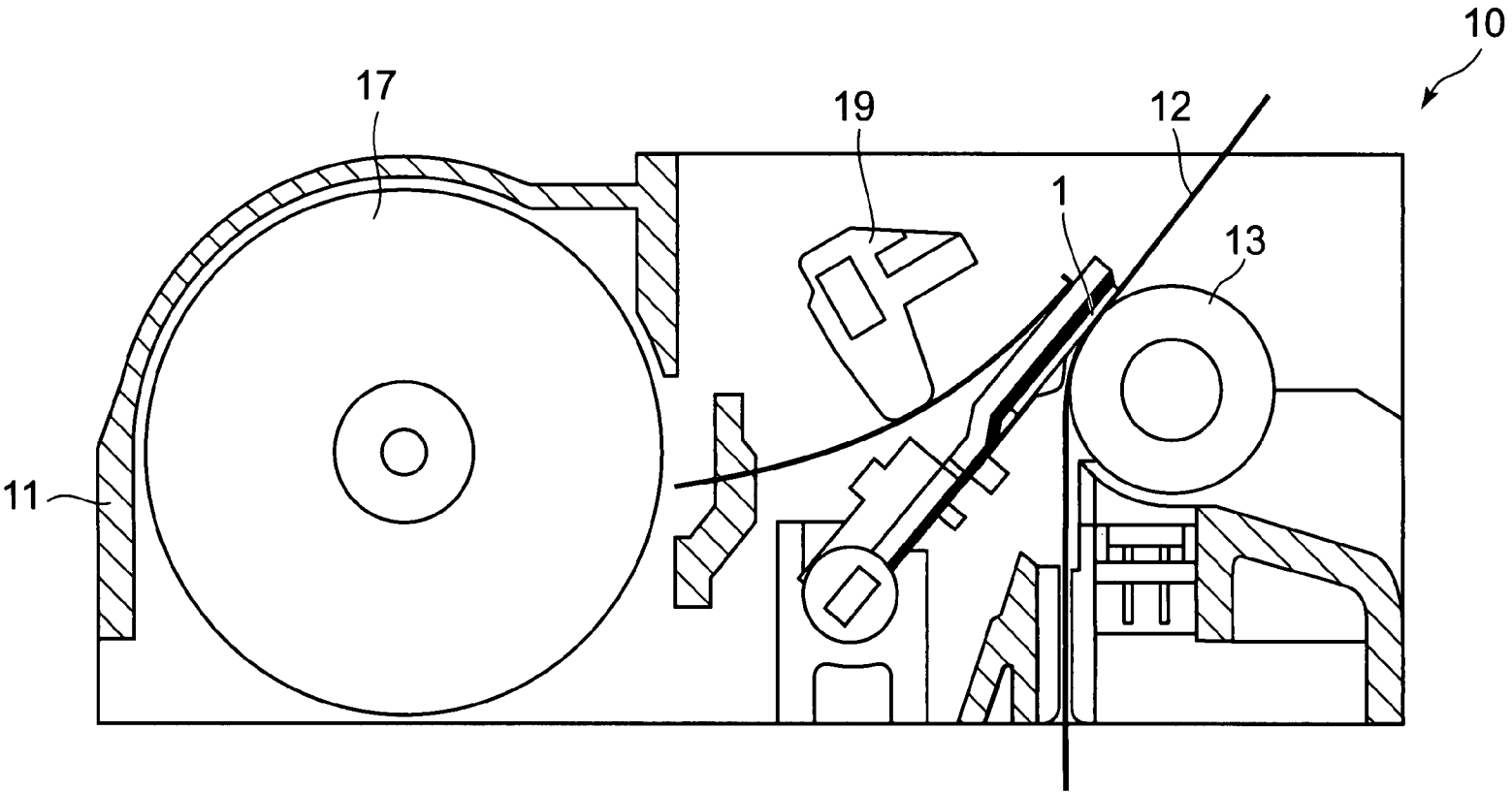
FIG. 1 is a schematic view of a structure of a thermal printer according to a first embodiment of the present invention.

The manufacturing method A for a thermal head according to this embodiment is a manufacturing method, for example, for a thermal head 1 used in a thermal printer 10 illustrated in FIG. 1.

The thermal printer 10 includes: a main body frame 11; a platen roller 13 arranged horizontally; the thermal head 1 arranged so as to be opposed to the outer peripheral surface of the platen roller 13; a heat dissipation plate 15 (see FIG. 2) supporting the thermal head 1; a paper feeding mechanism 17 for feeding an object to be printed such as thermal paper 12 between the platen roller 13 and the thermal head 1; and a pressure mechanism 19 for pressing the thermal head 1 with a predetermined pressing force with respect to the thermal paper 12.

Against the platen roller 13, the thermal head 1 and the thermal paper 12 are pressed by the operation of the pressure mechanism 19. With this, load of the platen roller 13 is applied to the thermal head 1 through an intermediation of the thermal paper 12.

The heat dissipation plate 15 is a plate-shaped member made of a resin, ceramics, glass, metal such as aluminum, or the like, and serves for fixation and heat dissipation of the thermal head 1.

Figure 2:
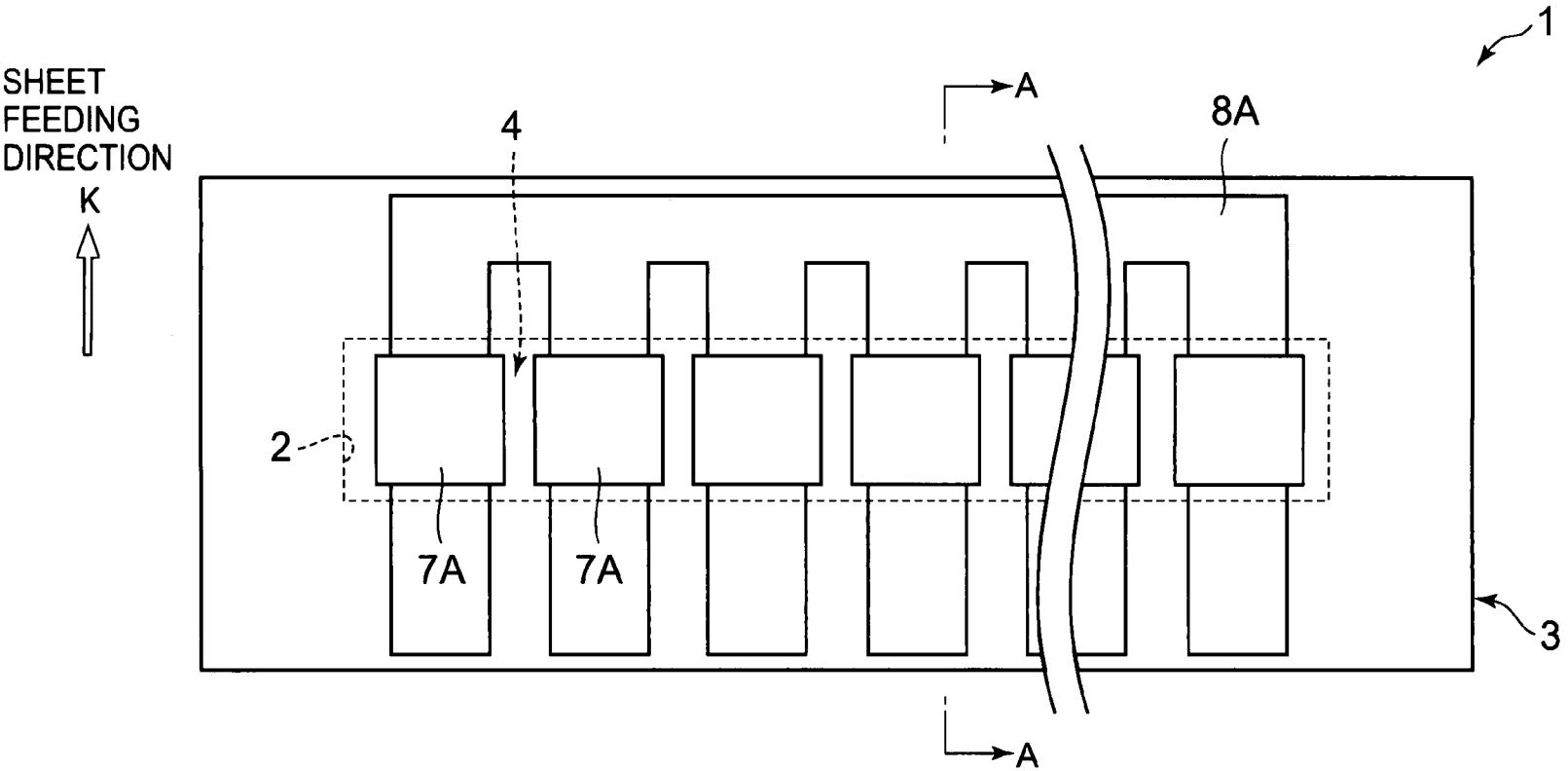
FIG. 2 is a plane view of a thermal head of FIG. 1 as seen from a protective film side.
Figure 3:
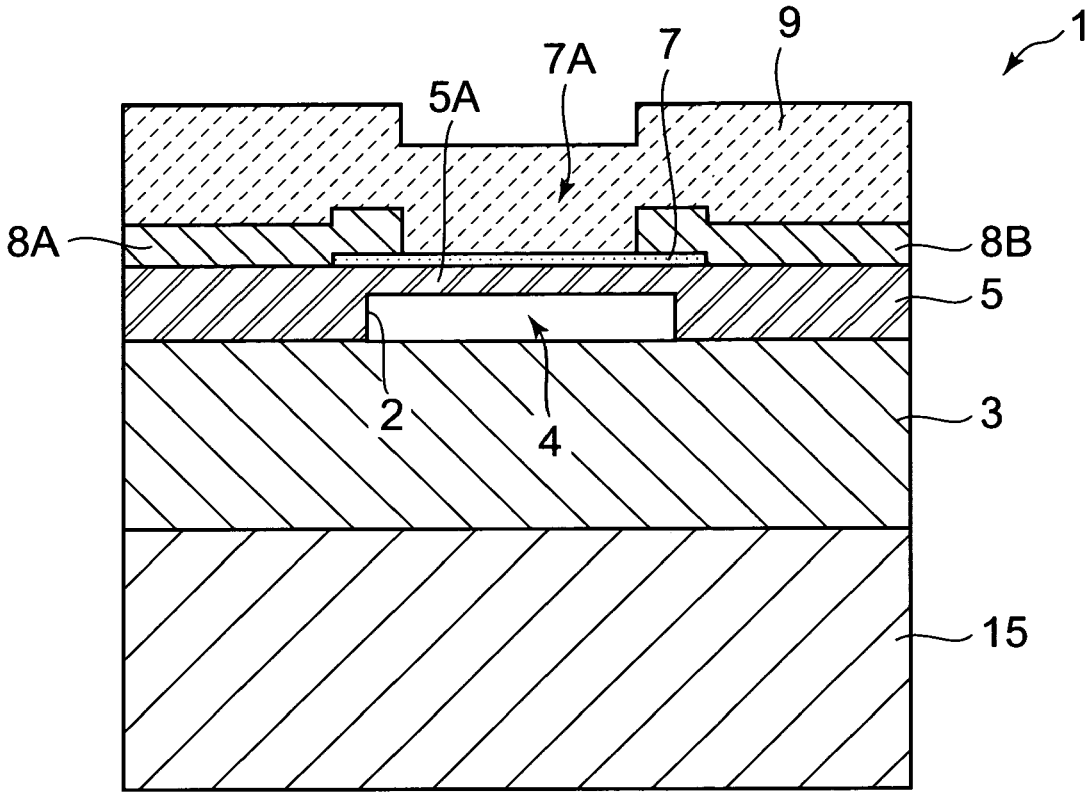
FIG. 3 is a sectional view of the thermal head of FIG. 2 taken along the arrow A-A.

The thermal head 1 has a plate shape as illustrated in FIG. 2. As illustrated in FIG. 3 (which is a sectional view taken along the arrow A-A of FIG. 2), the thermal head 1 includes: a rectangular supporting substrate (supporting plate) 3 fixed on the heat dissipation plate 15; a heat storage layer 5 bonded onto the surface of the supporting substrate 3; a plurality of heating resistors 7 provided on the heat storage layer 5; electrode portions 8A, 8B connected to the heating resistors 7; and a protective film 9 covering the heating resistors 7 and the electrode portions 8A, 8B so as to protect the same from abrasion and corrosion. Note that, an arrow K of FIG. 2 indicates a feeding direction of the thermal paper 12 by the paper feeding mechanism 17.

It is desirable that the supporting substrate 3 have higher strength. For example, the supporting substrate 3 is an insulating substrate made of glass, metal, ceramics, or the like and having a thickness of approximately 300 μm to 1 mm.

The heat storage layer 5 is constituted by a thin plate glass having a thickness of approximately 10 to 50 μm. In the surface on the supporting substrate 3 side of the heat storage layer 5, there is formed a rectangular hollow concave portion 2 extending in a longitudinal direction. The heat storage layer 5 and the supporting substrate 3 are directly bonded to each other by an adhesive or anodic bonding.

The hollow concave portion 2 of the heat storage layer 5 is covered with the supporting substrate 3, whereby a hollow portion (hereinafter, referred to as "hollow heat insulating layer") 4 is formed between the supporting substrate 3 and the heat storage layer 5. A bottom portion of the hollow concave portion 2, that is, a thin plate portion (hereinafter, referred to as "thin plate portion 5A") situated on the hollow heat insulating layer 4 of the heat storage layer 5 has a thickness of approximately 10 μm.

The hollow heat insulating layer 4 functions as a heat insulating layer for suppressing the flow of heat generated in the heating resistors 7 from the thin plate portion 5A of the heat storage layer 5 into the supporting substrate 3, and has a communicating structure opposed to all the heating resistors 7. The hollow portion functions as the heat insulating layer, and hence an amount of heat transferred above the heating resistors 7 to be used for printing and the like becomes larger than an amount of heat transferred to the heat storage layer 5 below the heating resistors 7. Thus, it is possible to improve heating efficiency.

The heating resistors 7 are each provided so as to straddle the hollow concave portion 2 in its width direction on an upper end surface of the heat storage layer 5, and are arranged at predetermined intervals in the longitudinal direction of the hollow concave portion 2. In other words, each of the heating resistors 7 is provided to be opposed to the hollow heat insulating layer 4 through an intermediation of the thin plate portion 5A of the heat storage layer 5 so as to be situated above the hollow heat insulating layer 4.

The electrode portions 8A, 8B serve to heat the heating resistors 7, and are constituted by a common electrode 8A connected to one end of each of the heating resistors 7 in a direction orthogonal to the arrangement direction of the heating resistors 7, and individual electrodes 8B connected to the other end of each of the heating resistors 7. The common electrode 8A is integrally connected to all the heating resistors 7, whereas the individual electrodes 8B are connected to the heating resistors 7, respectively.

When voltage is selectively applied to the individual electrodes 8B, current flows through the heating resistors 7 connected to the selected individual electrodes 8B and the common electrode 8A opposed thereto, whereby the heating resistors 7 are heated. In this state, the thermal paper 12 is pressed by the operation of the pressure mechanism 19 against the surface portion (printing portion) of the protective film 9 covering the heating portions of the heating resistors 7, whereby color is developed on the thermal paper 12 and printing is performed.

Note that, of each of the heating resistors 7, an actually heating portion (hereinafter, referred to as "heating portion 7A") is a portion of each of the heating resistors 7 on which the electrode portions 8A, 8B do not overlap, that is, a portion of each of the heating resistors 7 which is a region between the connecting surface of the common electrode 8A and the connecting surface of each of the individual electrodes 8B and is situated substantially directly above the hollow heat insulating layer 4.

Hereinafter, a manufacturing method A of the thermal head 1 constructed as described above (hereinafter, simply referred to as "manufacturing method A") is described.

Figure 4A:
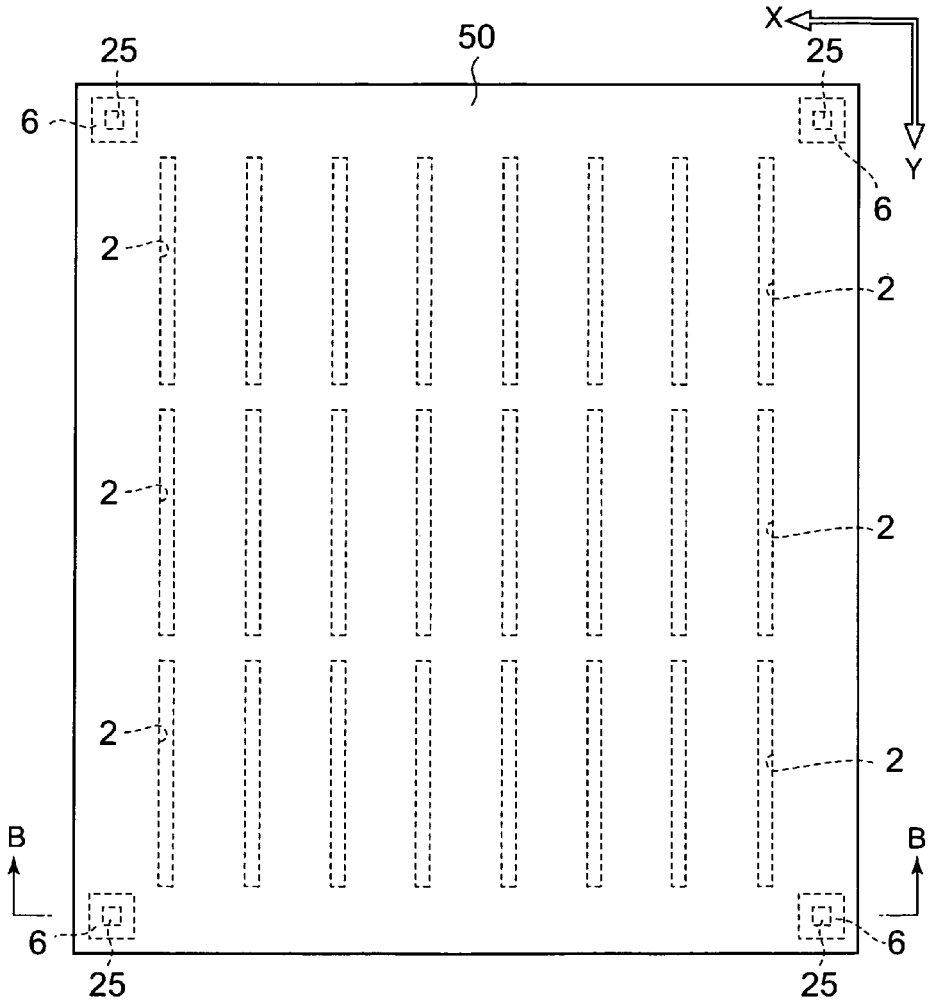
FIG. 4A is a plane view illustrating a state as seen from a thin plate glass side, in which a large-sized thin plate glass and a supporting substrate are bonded to each other.
Figure 4B:
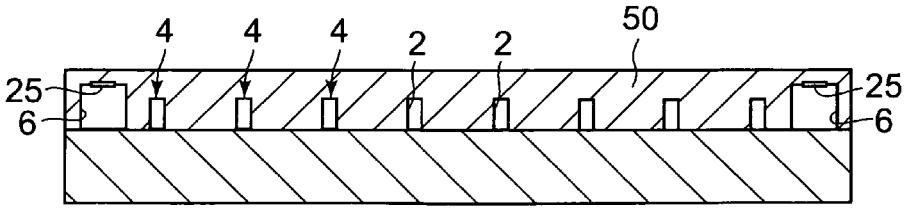
FIG. 4B is a sectional view of FIG. 4A, which is taken along the arrow B-B.

In the manufacturing method A according to this embodiment, as illustrated in FIGS. 4A and 4B, a large number of thermal heads 1 are formed by bonding a large-sized rectangular thin plate glass (substrate) 50 and the supporting substrate 3 to each other. In FIG. 4A, the longitudinal direction of the thin plate glass 50 is indicated by an arrow Y, and the width direction thereof is indicated by an arrow X.

Figure 5:
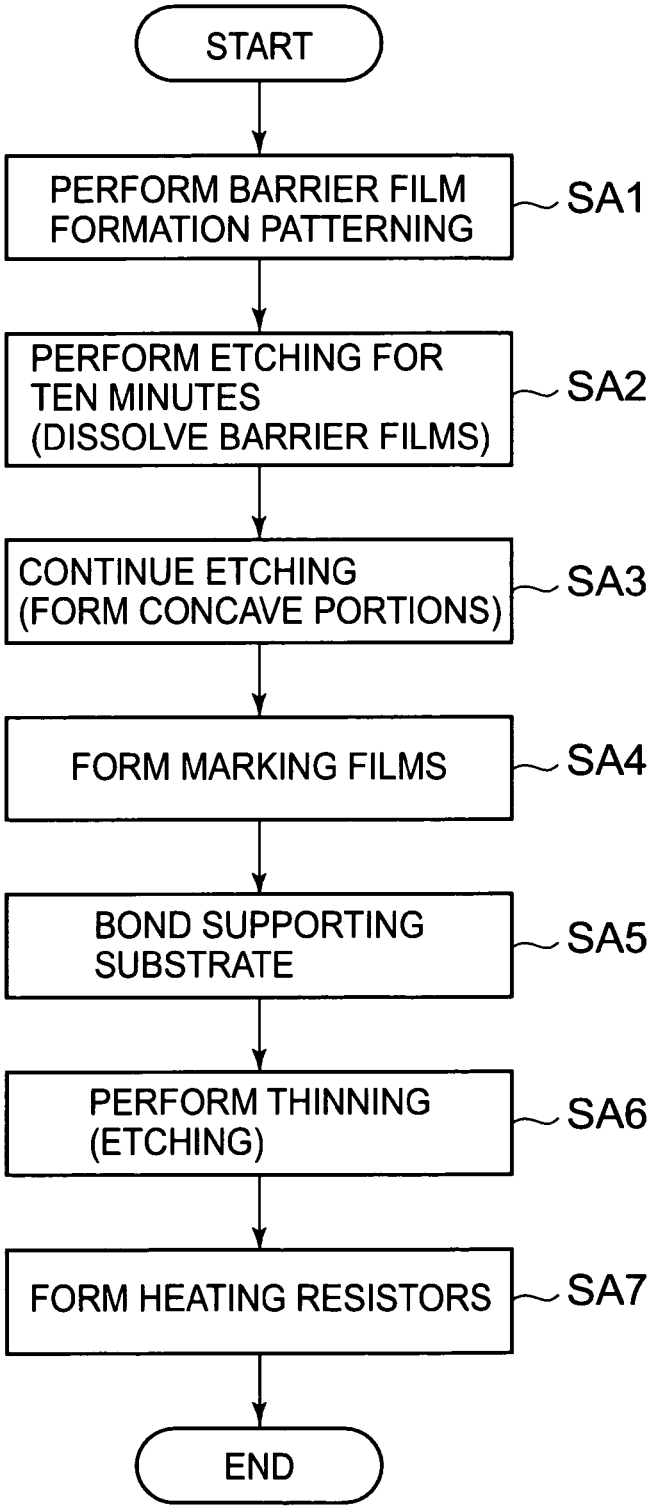
FIG. 5 is a flowchart illustrating a manufacturing method for a thermal head according to the first embodiment of the present invention.

The manufacturing method A includes: a barrier film forming step of forming barrier films 21 (see FIG. 6) in a region in which the hollow concave portions 2 of the thin plate glass 50 serving as the heat storage layer 5 are formed; a concave portion forming step of forming the hollow concave portions 2 and marking concave portions 6 (see FIG. 7); a bonding step of bonding the supporting substrate 3 onto one surface 50A of the thin plate glass 50 in which the hollow concave portions 2 and the marking concave portions 6 are formed; a thinning step of thinning the thin plate glass 50 onto which the supporting substrate 3 is bonded; and a heating resistor forming step of forming the heating resistors 7 on a back surface 50B of the thinned thin plate glass 50. Hereinafter, with reference to a flowchart of FIG. 5, each of the steps is specifically described.

Figure 6:
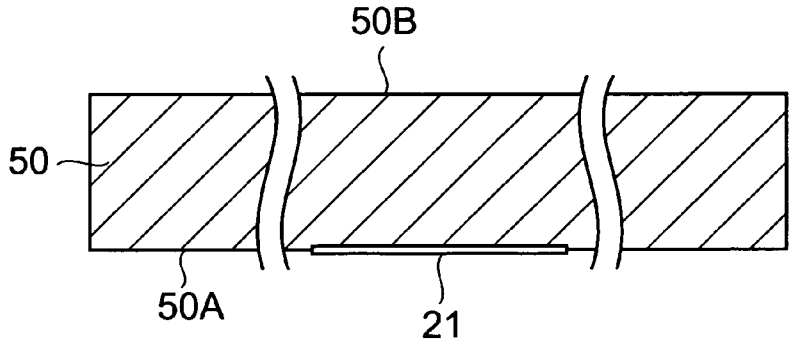
FIG. 6 is a vertical sectional view illustrating a state in which barrier films are formed on the large-sized thin plate glass.

First, as illustrated in FIG. 6, on the one surface 50A of the large-sized thin plate glass 50 having a thickness of approximately 200 to 500 μm, there are formed the barrier films 21 having an etching rate lower than the etching rate of glass. Then, patterning is performed so that the barrier films 21 are left only in the region in which the hollow concave portions 2 are formed (Step A1: barrier film forming step).

As the barrier films 21, for example, there are used aluminum and tantalum having higher tolerance for hydrogen-fluoride-based wet etching with respect to the glass. Further, the hollow concave portions 2 are formed so that grooves extending in the longitudinal direction Y of the thin plate glass 50 are arranged, for example, in three rows in the longitudinal direction Y and in eight columns in the width direction X. Further, the marking concave portions 6 are formed as grooves having a substantially quadrangular prism shape and arranged at four corners of the thin plate glass 50, respectively.

Next, by photolithography technology, photoresists 23 are formed in a region other than the region in which the hollow concave portions 2 are formed (region in which the barrier films 21 are left) and the region in which the marking concave portions 6 are formed.

In the case where the thickness of the thin plate portions 5A of the heat storage layers 5 is set to approximately 10 μm, the thickness of the barrier films 21 is set to, for example, approximately 1 μm. Further, the etching rate of the thin plate glass 50 is set to 1 μm per minute, and the etching rate of the barrier films 21 is set to 0.1 μm per minute. Under this condition, etching is performed uniformly on the one surface 50A of the thin plate glass 50 (concave portion forming step).

Figure 7:
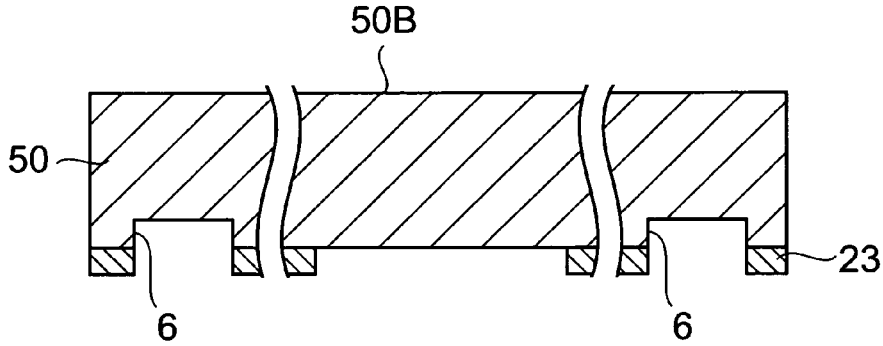
FIG. 7 is a vertical sectional view illustrating a state of the thin plate glass of FIG. 6, which has been subjected to etching for ten minutes.

After the etching is performed for ten minutes, as illustrated in FIG. 7, all the barrier films 21 are dissolved and the marking concave portions 6 having the depth of approximately 10 μm are formed (Step A2). In this state, the etching is further performed uniformly on the one surface 50A of the thin plate glass 50, whereby the hollow concave portions 2 having a predetermined depth and the marking concave portions 6 having a depth larger than that of the hollow concave portions 2 by approximately 10 μm are formed.

Figure 8:
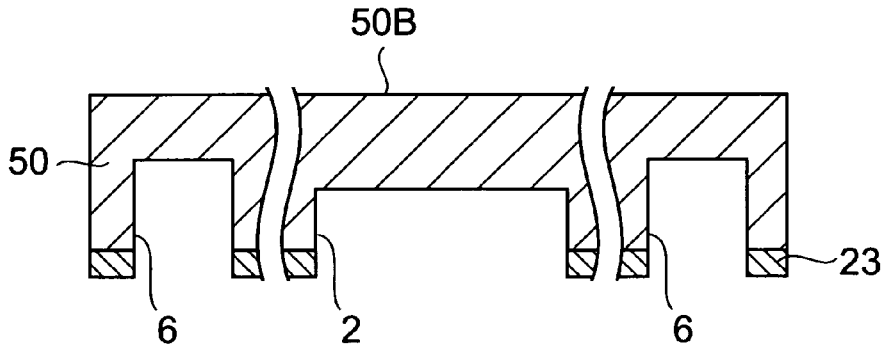
FIG. 8 is a vertical sectional view illustrating a state in which hollow concave portions and marking concave portions are formed in the thin plate glass of FIG. 7.

In the concave portion forming step, as illustrated in FIG. 8, the etching is continuously performed until a desired depth of the hollow concave portions 2 is obtained (Step A3). A difference between the etching rate of the hollow concave portions 2 and the etching rate of the marking concave portions 6 is provided by the barrier films 21. As a result, in the concave portion forming step, it is possible to form the hollow concave portions 2 and the marking concave portions 6 having the depths different from each other in a single etching process.

Figure 9:
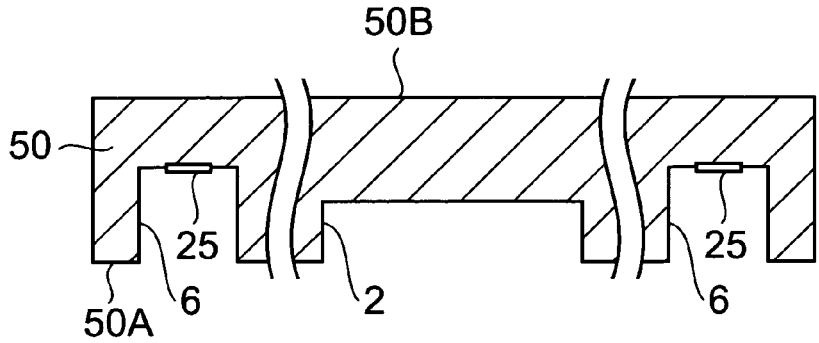
FIG. 9 is a vertical sectional view illustrating a state in which marking films are formed in the markings concave portions of the thin plate glass of FIG. 8.

After the hollow concave portions 2 and the marking concave portions 6 are formed on the thin plate glass 50 by the concave portion forming step, as illustrated in FIG. 9, all the photoresists 23 are peeled off from the one surface 50A of the thin plate glass 50, and marking films 25 for detection of completion of etching are formed on the bottom surfaces of the marking concave portions 6 (Step A4). The formation of the marking films 25 is performed by a process such as a mask vapor deposition, mask sputtering, and screen-printing. It is desirable that the marking films 25 be opaque marks and formed to have a size enough to be seen by naked eyes.

Figure 10:
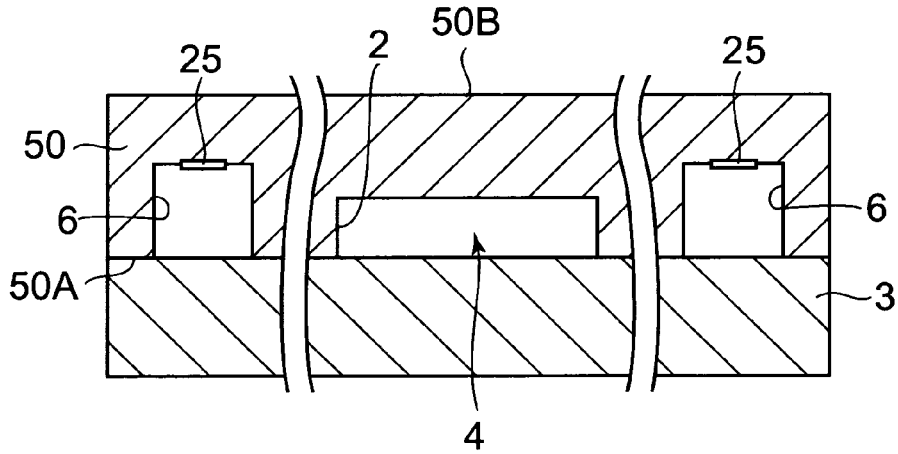
FIG. 10 is a vertical sectional view illustrating a state in which the supporting substrate is bonded onto one surface of the thin plate glass of FIG. 9.

Next, as illustrated in FIG. 10, the supporting substrate 3 is bonded onto the one surface 50A of the thin plate glass 50 in which the hollow concave portions 2 and the marking concave portions 6 are formed by the concave portion forming step (Step A5: bonding step). The thin plate glass 50 and the supporting substrate 3 are bonded to each other by an adhesive. Note that, without use of an adhesive, the thin plate glass 50 and the supporting substrate 3 may be directly bonded to each other by the anodic bonding or the like.

The one surface 50A of the thin plate glass 50 is covered with the supporting substrate 3, in other words, the openings of the hollow concave portions 2 are covered with the supporting substrate 3, whereby the hollow portions (hollow heat insulating layers) 4 are formed between the thin plate glass 50 and the supporting substrate 3. The thickness of the hollow portions is determined based on the depth of the hollow concave portions 2, and hence it is possible to easily control the thickness of the hollow heat insulating layers 4.

Figure 11:
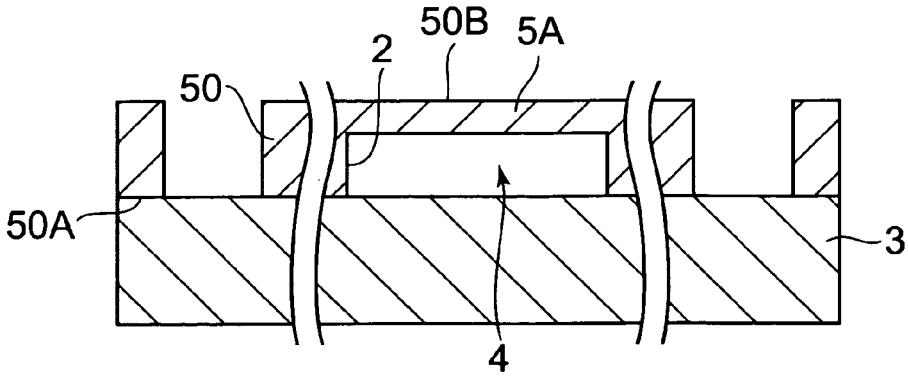
FIG. 11 is a vertical sectional view illustrating a state in which the thin plate glass of FIG. 10 is thinned.

Next, as illustrated in FIG. 11, the thin plate glass 50, onto which the supporting substrate 3 is bonded in the bonding step, is uniformly thinned until the marking concave portions 6 extend through the thin plate glass 50 from the back surface 50B side opposite to the one surface 50A (Step A6: thinning step). The thinning of the thin plate glass 50 is performed by the same etching as that in the concave portion forming step.

In this case, the difference between the depth of the hollow concave portions 2 and the depth of the marking concave portions 6 is set to 10 μm. Thus, at the point in time when the marking concave portions 6 extend through the thin plate glass 50 and all portions of the glass, on which the marking films 25 are formed, are dissolved, the thin plate portions 5A having the thickness of approximately 10 μm are formed above the hollow heat insulating layers 4 of the thin plate glass 50 as the heat storage layer 5. At this point in time, the marks disappear, and hence the etching of the thin plate glass 50 is terminated.

It is difficult to manufacture and handle a thin plate glass having a thickness of 100 μm or less, and such a thin plate glass is expensive. Thus, instead of bonding an originally thin plate glass directly onto the supporting substrate 3, the thin plate glass 50 having the thickness allowing easy manufacture and handling thereof is bonded onto the supporting substrate 3, and then the thin plate glass 50 is processed by the etching so that the thin plate portions 5A have a desired thickness. As a result, it is possible to easily form the extremely thin heat storage layer 5 over one surface of the supporting substrate 3 at low cost.

Next, the heating resistors 7, the common electrode 8A, the individual electrodes 8B, and the protective film 9 are sequentially formed on the heat storage layer 5 (Step A7: heating resistor forming step and the like). The heating resistors 7, the common electrode 8A, the individual electrodes 8B, and the protective film 9 can be manufactured by using a well-known manufacturing method for a conventional thermal head.

Specifically, in the heating resistor forming step, a thin film formation method such as sputtering, chemical vapor deposition (CVD), or vapor deposition is used to form a thin film made of a Ta-based or silicide-based heating resistor material on the heat storage layer 5. Then, the thin film made of the heating resistor material is molded by lift-off, etching, or the like, whereby the heating resistor 7 having a desired shape is formed.

Subsequently, as in the heating resistor forming step, the film formation with use of a wiring material such as Al, Al—Si, Au, Ag, Cu, and Pt is performed on the heat storage layer 5 by using sputtering, vapor deposition, or the like. Then, the film thus obtained is formed by lift-off or etching, or the wiring material is screen-printed and is, for example, burned thereafter, to thereby form the common electrode 8A and the individual electrodes 8B which have the desired shape. Note that, the heating resistors 7, the common electrode 8A, and the individual electrodes 8B are formed in an appropriate order.

In the lift-off for the heating resistors 7 and the electrode portions 8A, 8B or in the patterning of a resist material for the etching, the patterning is performed on the resist material by using a photomask.

After the formation of the heating resistors 7, the common electrodes 8A, and the individual electrodes 8B, the film formation with use of a protective film material such as $SiO_2$, $Ta_2O_5$, SiAlON, $Si_3N_4$, or diamond-like carbon is performed on the heat storage layer by sputtering, ion plating, chemical vapor deposition (CVD), or the like, whereby the protective film 9 is formed. Then, the large-sized thin plate glass 50 and the supporting substrate 3 are cut, whereby the individual thermal heads 1 are completed.

As described above, in the manufacturing method A for the thermal head 1 according to the present invention, the hollow heat insulating layers 4 are formed between the heat storage layer 5 and the supporting substrate 3. The hollow heat insulating layers 4 suppress the transfer of the heat generated on the heating portions 7A of the heating resistors 7 to the supporting substrate 3 through an intermediation of the heat storage layer 5, and hence it is possible to manufacture the thermal heads 1 having high energy efficiency.

Further, the thickness of the thin plate portions 5A above the hollow heat insulating layers 4 supporting the heating resistors 7 is determined by the difference between the depth of the hollow concave portions 2 and the depth of the marking concave portions 6. Thus, in the concave portion forming step, even though the hollow concave portions 2 and the marking concave portions 6 are solely formed so as to have desired depths, respectively, it is possible to control the thickness of the thin plate portions 5A precisely. Further, the hollow concave portions 2 and the marking concave portions 6 are formed in the thin plate glass 50 which has not been thinned yet, and the thin plate glass 50 is thinned while being reinforced by the supporting substrate 3, whereby it is possible to prevent the hollow portions from breaking during the manufacturing process. As a result, it is possible to manufacture the thermal heads 1 having high heating efficiency and stable quality.

Second Embodiment

Figure 12:
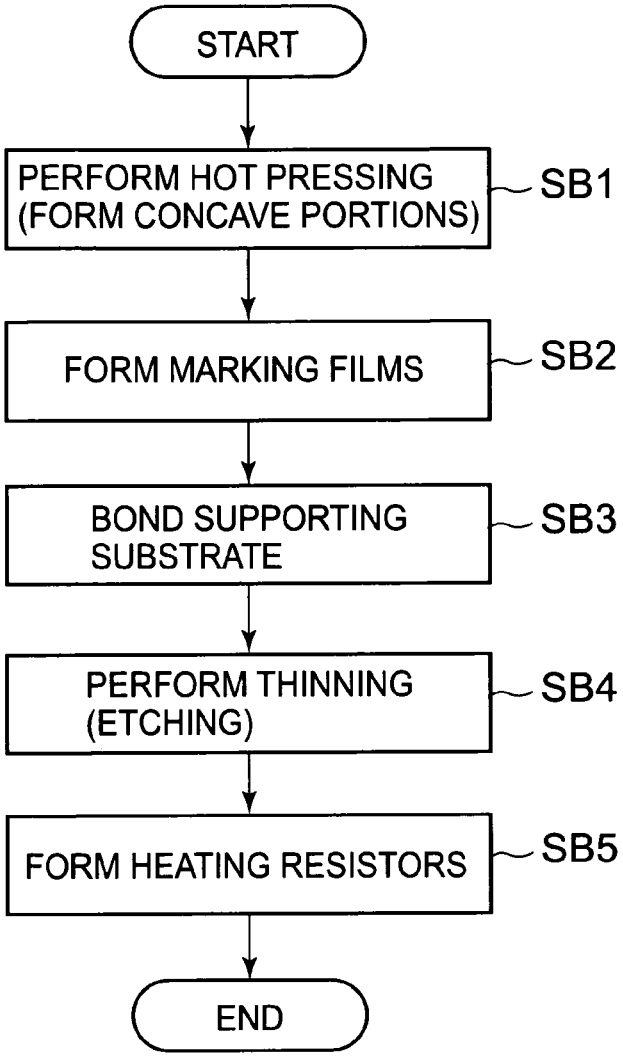
FIG. 12 is a flowchart illustrating a manufacturing method for a thermal head according to a second embodiment of the present invention.

Hereinafter, a manufacturing method B of the thermal head 1 according to a second embodiment of the present invention (hereinafter, simply referred to as "manufacturing method B") is described with reference to a flowchart of FIG. 12.

The manufacturing method B according to this embodiment is different from the manufacturing method A according to the first embodiment in that, in the concave portion forming step, the hollow concave portions 2 and the marking concave portions 6 are formed by hot pressing, instead of the etching with use of the barrier films 21.

Hereinafter, in the description of this embodiment, portions having the common structures with those in the manufacturing method A for the thermal head 1 according to the first embodiment are denoted by the same reference symbols, and description thereof is omitted.

Figure 13:
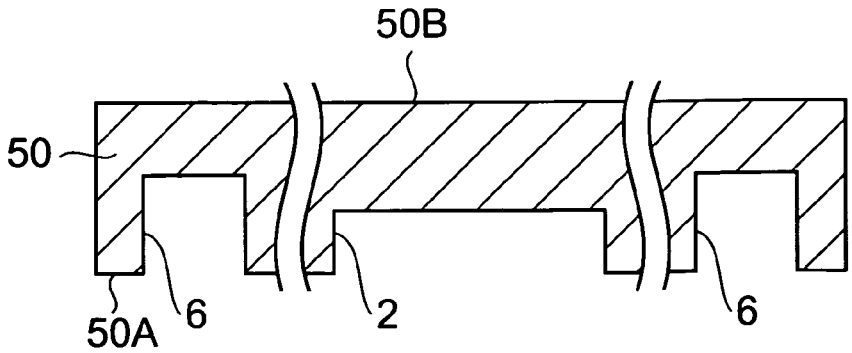
FIG. 13 is a vertical sectional view illustrating a state in which the hollow concave portions and the marking concave portions are formed in the thin plate glass.

In the concave portion forming step, as illustrated in FIG. 13, the hot pressing is performed in a region of the one surface 50A of the thin plate glass 50 in which the hollow concave portions 2 are formed and in a region thereof in which the marking concave portions 6 are formed (Step B1: concave portion forming step). The hollow concave portions 2 and the marking concave portions 6 are formed so that the marking concave portions 6 have the depth equal to the depth of the hollow concave portions 2 plus the thickness of the thin plate portions 5A of the heat storage layer 5.

Figure 14:
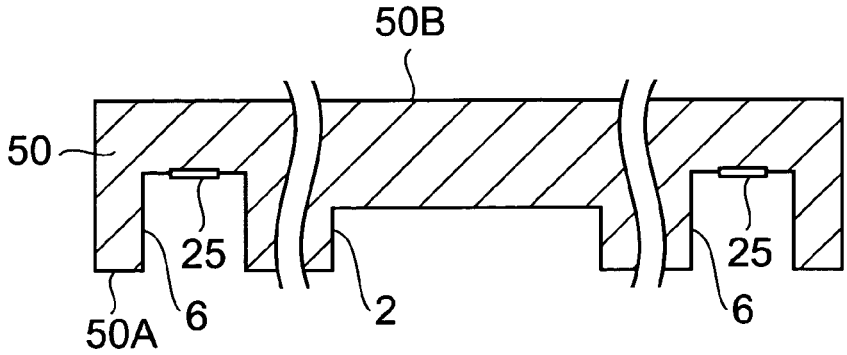
FIG. 14 is a vertical sectional view illustrating a state in which the marking films are formed in the marking concave portions of the thin plate glass of FIG. 13.
Figure 15:
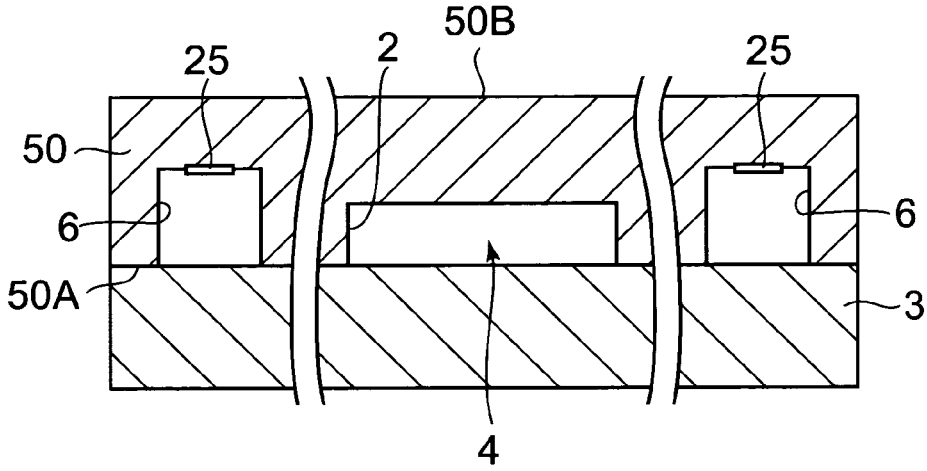
FIG. 15 is a vertical sectional view illustrating a state in which the supporting substrate is bonded onto the one surface of the thin plate glass of FIG. 14.
Figure 16:
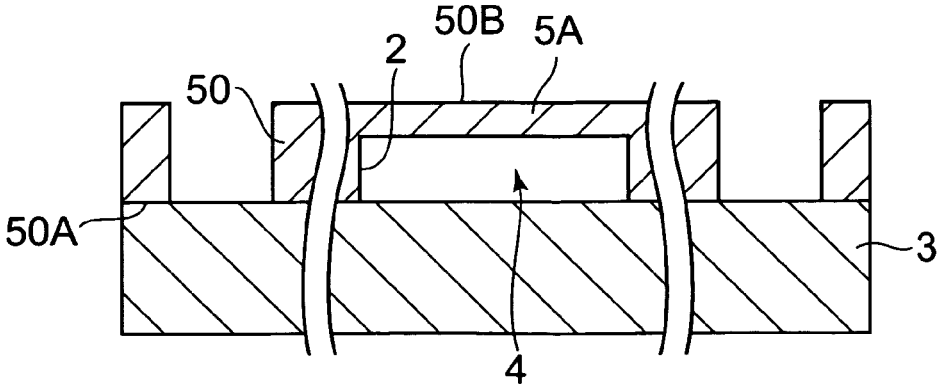
FIG. 16 is a vertical sectional view illustrating a state in which the thin plate glass of FIG. 15 is thinned.

For example, in the case where the depth of the hollow concave portions 2 is set to 100 μm and the thickness of the thin plate portions 5A is set to approximately 10 μm, the depth of the marking concave portions 6 may be set to 110 μm. Hereinafter, Steps B2 to B5 such as a bonding step, a thinning step, and a heating resistor forming step are the same as Steps A4 to A7 according to the first embodiment (see FIGS. 14 to 16).

As described above, with the manufacturing method B according to this embodiment, it is possible to easily form the hollow concave portions 2 and the marking concave portions 6 each having the desired depth by the hot pressing.

As described above, while the embodiments of the present invention are described with reference to the drawings, the specific structure is not limited to those embodiments. The present invention also includes design modifications and the like without departing from the spirit of the present invention.

What is claimed is:

1. A manufacturing method for a thermal head, comprising:

a concave portion forming step of forming a hollow concave portion and a marking concave portion having a depth larger than a depth of the hollow concave portion on one surface of a substrate;

a bonding step of bonding a supporting plate onto the one surface of the substrate, in which the hollow concave portion and the marking concave portion are formed in the concave portion forming step;

a thinning step of thinning the substrate onto which the supporting plate is bonded in the bonding step until the marking concave portion extends through the substrate from a side of a back surface opposite to the one surface; and a heating resistor forming step of forming a heating resistor on the back surface of the substrate thinned in the thinning step so as to be opposed to the hollow concave portion.

2. The manufacturing method for a thermal head according to claim 1, wherein, in the concave portion forming step, the hollow concave portion and the marking concave portion are formed such that a difference between the depth of the hollow concave portion and the depth of the marking concave portion is set to be equal to a thickness of the substrate on which the heating resistor is supported.

3. The manufacturing method for a thermal head according to claim 2, further comprising a barrier film forming step of forming a barrier film for reducing an etching rate in a region of the one surface of the substrate, in which the hollow concave portion is formed, wherein, in the concave portion forming step, etching is performed in the region of the one surface of the substrate, in which the hollow concave portion is formed and in a region of the one surface of the substrate, in which the marking concave portion is formed.

4. The manufacturing method for a thermal head according to claim 2, wherein, in the concave portion forming step, hot pressing is performed in a region of the one surface of the substrate, in which the hollow concave portion is formed and in a region of the one surface of the substrate, in which the marking concave portion is formed.

5. The manufacturing method for a thermal head according to claim 1, further comprising a barrier film forming step of forming a barrier film for reducing an etching rate in a region of the one surface of the substrate, in which the hollow concave portion is formed, wherein, in the concave portion forming step, etching is performed in the region of the one surface of the substrate, in which the hollow concave portion is formed and in a region of the one surface of the substrate, in which the marking concave portion is formed.

6. The manufacturing method for a thermal head according to claim 1, wherein, in the concave portion forming step, hot pressing is performed in a region of the one surface of the substrate, in which the hollow concave portion is formed and in a region of the one surface of the substrate, in which the marking concave portion is formed.

* * * * *